United States Patent [19]

Valdivia

[11] 4,428,538

[45] Jan. 31, 1984

[54] GRINDING DISC FOR DISC REFINERS

[75] Inventor: Juan Valdivia, Heidenheim, Fed. Rep. of Germany

[73] Assignee: J. M. Voith GmbH, Fed. Rep. of Germany

[21] Appl. No.: 279,523

[22] Filed: Jul. 1, 1981

[51] Int. Cl.[3] ..... B02C 7/12

[52] U.S. Cl. ..... 241/298; 241/261.2

[58] Field of Search ..... 241/296, 298, 251, 261.2, 241/261.3, 252, 253, 297

[56] References Cited

U.S. PATENT DOCUMENTS

| | | | |
|---|---|---|---|
| 246,476 | 8/1881 | Derby | 241/298 |
| 3,745,645 | 7/1973 | Kurth et al. | 241/296 X |
| 4,023,737 | 5/1977 | Leider et al. | 241/298 X |
| 4,157,669 | 6/1979 | Pilao | 241/298 X |

FOREIGN PATENT DOCUMENTS 19032 of 1882 Fed. Rep. of Germany .

*Primary Examiner*—Mark Rosenbaum

*Attorney, Agent, or Firm*—Ostrolenk, Faber, Gerb & Soffen

[57] ABSTRACT

A grinding disc for a disc refiner is disclosed. The grinding disc is comprised of a plurality of packs of strips. Each pack of strips is comprised of a plurality of parallel grinding strips which alternate with intermediate strips. The rear-to-front grinding surface height of the grinding strips is greater than that of the intermediate strips. Annular supporting rings define the radially inward and outward ends of the grinding strips. The grinding strips extend generally radially of the grinding disc. In an alternate embodiment, the intermediate strips are of meandering shape, whereby one intermediate strip extends between pluralities of adjacent grinding strips. The grinding and intermediate strips of a pack thereof are welded together and are welded to the supporting rings. An additional ring may be positioned to the rear of the strips intermediate the radially inward and outward ends thereof. Attachment holes for attaching the grinding disc to a support pass front to back through the grinding disc in the radial region of the additional ring.

21 Claims, 4 Drawing Figures

GRINDING DISC FOR DISC REFINERS

BACKGROUND OF THE INVENTION

The present invention relates to a grinding disc for a disc refiner useful, for example, in grinding wood.

One type of such disc includes at least one plurality of grinding strips extending across the front face of the grinding disc. The strips are oriented to extend across the face, may extend generally radially, but are oriented so as to deviate from the radial orientation by an acute angle at most. In each plurality thereof, the grinding strips are parallel.

One such grinding disc is known from U.S. Pat. No. 4,157,669. In that grinding disc, the grinding strips must be individually fastened to the supporting rings for the strips, particularly by welding.

SUMMARY OF THE INVENTION

The object of the present invention is to develop a grinding disc that can be manufactured in a simple, time-saving manner and which disc has great strength.

According to the invention, a grinding disc of the aforementioned type has the adjacent grinding strips in each plurality thereof separated by an intermediate strip having a shorter height, along the direction from the rear side to the front grinding face of the grinding disc, than the grinding strips, whereby the grinding strips extend further forward than the intermediate strips.

With this arrangement, there is the advantage that the grinding and intermediate strips can rest against each other. Furthermore, it is also possible to replace individual strips.

Other objects and features of the invention will be explained in further detail below with reference to the accompanying drawings.

DESCRIPTION OF THE PREFERRED EMBODIMENTS

Figure 1:
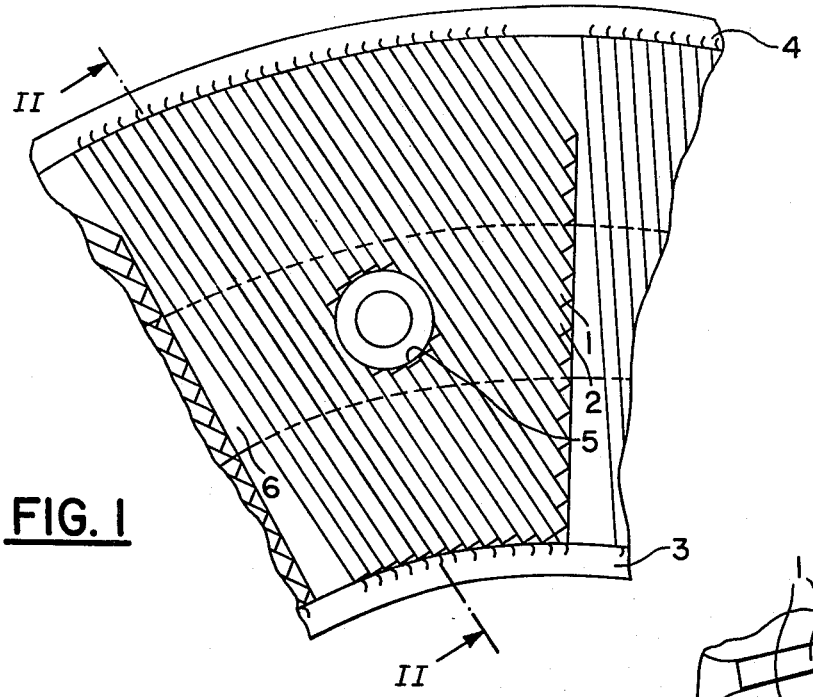
FIG. 1 is a view of a portion of the grinding disc of the invention, which essentially comprises a pack of grinding and intermediate strips.

The grinding disc in FIG. 1 includes the grinding strips 1, which are arranged in a number of pluralities or packs thereof arranged around the face of the grinding disc. As illustrated, the strips 1 of each plurality are oriented to extend generally radially over the face, but may be inclined from the radial orientation by at most an acute angle.

The grinding strips 1 in each plurality alternate across the disc with the intermediate strips 2. The strips 2 have the distinguishing features discussed below in conjunction with FIG. 2.

There is an outer supporting ring 4 and an inner supporting ring 3 for the pluralities of strips 1, 2. There is at least one and usually a plurality of attachment holes 5 passing through the disc. One of these holes is present about once per pack of strips. It serves for receiving a fastening element for the grinding disc to the grinding-disc support within the disc refiner.

Figure 2:
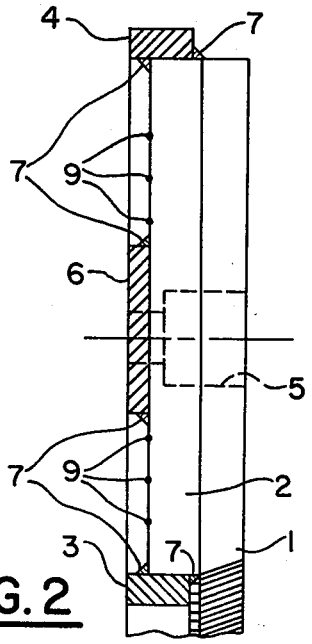
FIG. 2 is a sectional view along the line II—II of FIG. 1.

One method of attachment of the strips to the supporting rings 3 and 4 can be noted from FIG. 2. FIG. 2 shows an arrangement in which the supporting rings 3 and 4 radially limit the grinding strips on the inside and the outside, respectively. The strips 1 and 2 are fastened to the supporting rings 3 and 4 by fillet welds 7. FIG. 2 shows an arrangement in which the intermediate strips 2 are of shorter height, along the direction from the rear side to the front grinding face of the disc, than the grinding strips 1, whereby the grinding strips extend further forward than the intermediate strips. But, the two types of strips 1, 2 are positioned front to back so as to approximately define a plane at their rear ends. Before assembly of the grinding disc, the individual packs of strips are assembled together by tack welds 9 formed on the rear ends of the strips. The back side to front face heights of the strips 1, 2 is greater than the height of the supporting rings 3, 4. Additionally, the rings 3, 4, protrude rearwardly of the rear of the strips 1, 2.

FIG. 2 also shows an annular intermediate ring 6 which extends around the grinding disc and is also connected by fillet welds 7 to the rear ends of the strips 1 and 2. The fastening holes 5 for the grinding disc are also present within the annular region of the intermediate ring 6.

Instead of a rotating intermediate ring 6, individual flatirons or rotation guides (not shown) for each pack of strips 1, 2 could also be provided at the level of the intermediate ring, i.e. they can be welded in the same manner to the rear of the packs of strips. The ring 6 would be stationary on the support for the disc and the disc would rotate past the ring 6.

Figure 3:
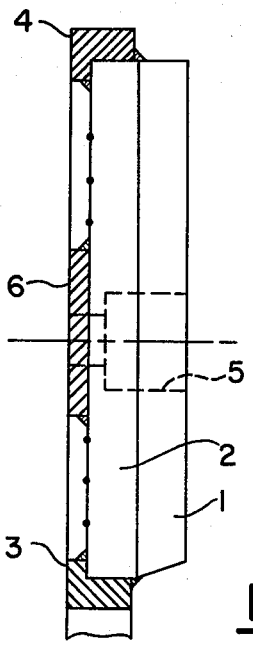
FIG. 3 is a sectional view corresponding to FIG. 2 but of a slightly modified embodiment.

FIG. 3 shows a somewhat different embodiment in which each of the annular supporting rings 3 and 4 has a collar at the rear ends of the strips 1, 2. On the this collar, the rear edges of the strips 1 and 2 rest. Otherwise, the construction of this embodiment is similar to that of FIG. 2. In both cases, there is the advantage that the welds can be made continuous at least for each pack of strips. On the other hand, however, the complete grinding disc, i.e. the total number of packs which together form a grinding disc, can also be assembled in a jig and can be held by clamps and the welds could be produced in a continuous form, for which purpose a robot apparatus could also be employed.

In the embodiment of FIG. 3, there is also the possibility of replacing the electric welds by solder connections, particularly connections produced by hard soldering, i.e. brazing.

Another possibility (not shown) would be to arrange the supporting rings 3, 4 behind the grinding and intermediate strips 1, 2 in such a manner that the rings do not protrude radially either toward the inside or outside beyond the strips. For instance, the rings may terminate precisely flush with the strips both at the radially inward and outward ends.

It is also possible to avoid the tack welds 9 and to clamp the individual strip packs in such a manner that they can be welded in a jig to form a complete grinding disc.

The packs of strips can be manufactured by first stacking the grinding and intermediate strips on a flat surface with the side thereof which is subsequently to be the front side facing downward. Height equalization strips are temporarily placed beneath the front sides of the intermediate strips so as to form at the rear of the pack of strips a flat, planar surface on which the tack welds can then be made. However, it is also possible to make the height equalization pieces somewhat narrower than the intermediate strips so that after stacking, the packs are held together with clamps. After assembly of and subsequent lifting of the pack, the height equalization pieces are allowed to drop out.

It is also possible to avoid the supporting rings and the intermediate ring and to produce the grinding disc by a build-up weld provided on the rear sides of the grinding and intermediate strips.

Furthermore, with the elimination of the supporting rings 3 and 4, the intermediate ring 6 can alone serve to hold together and form the grinding disc. Additional stiffening could be obtained by strong application of material in the form of strong electro-weld seams developed on the radially inner and outer edges of the grinding and intermediate strips essentially on their rear sides.

The packs of strips can also be produced by cutting, for instance sawing, several packs of strips to their final shapes from a large pack or stack of strips formed alternately of grinding and intermediate strips, e.g. where the intermediate strips are of larger, for instance equal, front to back length with the grinding strips.

Figure 4:
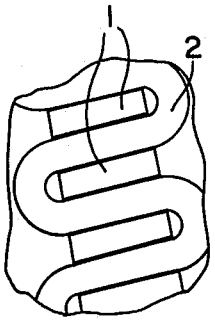
FIG. 4 is a fragmentary view showing another embodiment in accordance with the invention.

As shown in FIG. 4, it is also possible to form the intermediate strips from a band which is bent in a meandering shape back and forth. With precise manufacture so that the grinding strips 1 are clamped practically between the turns of the band, the assembling for the final grinding disc could be facilitated, for example, by avoiding clamping devices.

Although the present invention has been described in connection with a plurality of preferred embodiments thereof, many variations and modifications will now become apparent to those skilled in the art. It is preferred, therefore, that the foregoing invention be limited not by the specific disclosure herein, but only by the appended claims.

What is claimed is:

1. A grinding disc for a disc refiner, the disc having a front grinding face and an opposite rear side; the disc being comprised of at least one pack, including a plurality of initially separate, weldable material, grinding strips, and the grinding strips extending across the front face of the disc; the disc is annular, wherein the grinding strips each have a radially outward and a radially inward end, between adjacent grinding strips of the plurality, a respective intermediate strip being positioned; the intermediate strips being initially preformed, of weldable material and being of sufficient strength to rigidify the pack of grinding and intermediate strips;

at the rear side of the disc, the grinding strips and the intermediate strips are substantially planar;

measured from the rear side toward the front grinding face of the disc, the intermediate strips being shorter in height toward the front face of the disc than are the grinding strips;

an outward and an inward supporting ring for limiting the radially outward and radially inward ends, respectively, of the grinding strips; the grinding and intermediate strips both being welded to both supporting rings.

2. The grinding disc of claim 1, wherein there are a plurality of the packs, each including a respective plurality of the grinding strips and the respective intermediate strips between adjacent grinding strips.

3. The grinding disc of claim 2, further comprising attachment holes passing through at least some of the packs of grinding strips, front face to rear side, each for receiving a fastening element therethrough.

4. The grinding disc of claim 3, further comprising an additional ring fastened to the rear of the grinding strips and the intermediate strips and being located intermediate the radially inward and outward ends of the disc.

5. The grinding disc of claim 4, wherein the attachment holes are positioned each to pass through the grinding disc at the region thereof passed over by the additional ring.

6. The grinding disc of claim 2, wherein the grinding strips of each pack are oriented to extend across the front face of the disc at a different angle than the grinding strips of the others of the packs.

7. The grinding disc of claim 2, further comprising an additional ring fastened to the rear of the grinding strips and the intermediate strips and being located intermediate the radially inward and outward ends of the strips.

8. The grinding disc of claim 2, wherein the grinding strips are straight, and the intermediate strips are shaped in a meandering form across the front face of the disc such that an intermediate strip extends between two grinding strips, then around the edge of one of the two grinding strips, then between the one grinding strip and the next grinding strip, and so on between a plurality of adjacent grinding strips, in view of the meandering form of the intermediate strip.

9. The grinding disc of claim 1, wherein the grinding strips of the pack extend across the front face generally radially thereof.

10. The grinding disc of claim 9, wherein there are a plurality of packs, each including a respective plurality of the grinding strips and the respective intermediate strips between adjacent grinding strips.

11. The grinding disc of claim 10, wherein the grinding strips of each pack are oriented to extend across the front face of the disc at a different angle than the grinding strips of the others of the packs.

12. The grinding disc of claim 9, wherein the supporting rings are adjacent to the radially outward and radially inward ends of the grinding strips.

13. The grinding disc of claim 12, wherein the supporting rings protrude rearwardly with respect to the rear side of the grinding strips; both the grinding strips and the intermediate strips are of heights to protrude forwardly of the forward sides of the supporting rings.

14. The grinding disc of claim 13, wherein there are welds between the cooperating side surfaces of the strips and those end surfaces of the inward and outward supporting rings to which the strips are attached and there are welds between the radially inner side surface of the outer supporting ring and the radially outer side surface of the inner supporting ring, on the one hand, and the rear sides of the strips, on the other hand.

15. The grinding disc of claim 9, wherein the grinding and intermediate strips in a pack thereof are additionally attached to each other.

16. The grinding disc of claim 9, wherein the grinding and intermediate strips in a pack thereof are additionally attached to each other at the rear sides thereof.

17. The grinding disc of claim 9, wherein the grinding strips across the front face of the grinding disc are oriented at at most an acute angle from extending radially of the front face.

18. The grinding disc of claim 17, wherein there are a plurality of packs, each including a respective plurality of the grinding strips and the respective intermediate strips between adjacent grinding strips.

19. The grinding disc of claim 9, further comprising an additional ring fastened to the rear sides of the grinding strips and intermediate strips and located intermediate the radially inward and outward ends of the strips.

20. The grinding disc of claim 9, wherein the grinding strips are straight, and the intermediate strips are shaped in a meandering form across the front face of the disc such that an intermediate strip extends between two grinding strips, then around the edge of one of the two grinding strips, then between the one grinding strip and the next grinding strip, and so on between a plurality of adjacent grinding strips, in view of the meandering form of the intermediate strip.

21. The grinding disc of claim 1, further comprising an attachment hole passing through the pack of grinding strips, front face to rear side, for receiving a fastening element therethrough.

* * * * *